US009918593B2

(12) United States Patent
LeBlanc et al.

(10) Patent No.: US 9,918,593 B2
(45) Date of Patent: Mar. 20, 2018

(54) SOAP DISPENSING BODY SCRUBBER

(71) Applicants: Brent LeBlanc, Lincoln, CA (US); Scott Raitt, Grass Valley, CA (US)

(72) Inventors: Brent LeBlanc, Lincoln, CA (US); Scott Raitt, Grass Valley, CA (US)

( * ) Notice: Subject to any disclaimer, the term of this patent is extended or adjusted under 35 U.S.C. 154(b) by 0 days.

(21) Appl. No.: 15/090,083

(22) Filed: Apr. 4, 2016

(65) Prior Publication Data

US 2016/0287033 A1 Oct. 6, 2016

Related U.S. Application Data

(60) Provisional application No. 62/142,159, filed on Apr. 2, 2015.

(51) Int. Cl.
*A47K 7/02* (2006.01)
*A47K 7/03* (2006.01)

(52) U.S. Cl.
CPC ..... *A47K 7/03* (2013.01); *A47K 7/028* (2013.01)

(58) Field of Classification Search
CPC ..... A47K 7/03; A47K 7/028
USPC ..... 401/201
See application file for complete search history.

(56) References Cited

U.S. PATENT DOCUMENTS 3,768,916 A 10/1973 Avery
5,944,032 A 8/1999 Masterson
5,952,090 A 9/1999 Fan
6,224,283 B1 * 5/2001 Hay ..... A46B 11/0013 222/213
6,368,003 B1 * 4/2002 Sorrell ..... A47K 7/03 15/210.1
7,318,682 B2 * 1/2008 Anderson ..... A47K 7/03 401/183
7,589,053 B2 9/2009 Larsen
7,837,403 B2 * 11/2010 Willinger ..... A01K 13/001 119/603
8,002,486 B1 8/2011 Tran
8,061,566 B2 * 11/2011 LaFlamme ..... A47K 7/03 222/207
8,128,303 B2 * 3/2012 LaFlamme ..... A45D 34/04 222/383.1
8,152,400 B2 * 4/2012 LaFlamme ..... A47L 13/17 401/187
8,167,510 B2 * 5/2012 LaFlamme ..... A45D 34/04 401/188 R (Continued)

*Primary Examiner* — Jennifer C Chiang
(74) *Attorney, Agent, or Firm* — Global Intellectual Property Agency, LLC; Jordan Sworen

(57) ABSTRACT

A soap dispensing scrubber device is provided. The device comprises a top cap that is fillable with a liquid soap and a scrubber element removably attached thereto. The top cap comprises a squeezable material or one that is rigid with a dispensing button therealong. Liquid soap stored within the interior of the top cap is dispensed through a one-way valve along the lower end of the top cap. In one embodiment, the top cap is affixed to a base-lid assembly that supports the one-way valve. The base of the base-lid assembly is secured to the top cap and the base supports a hingedly attached lid therefrom. The base provides a fill hole and the lid secures thereover. The scrubber element is preferably affixed to the base a male snap coupler member, while in other embodiments the scrubber element secures to the base via one or more tabs.

19 Claims, 7 Drawing Sheets

(56) References Cited

U.S. PATENT DOCUMENTS

Figure 1:
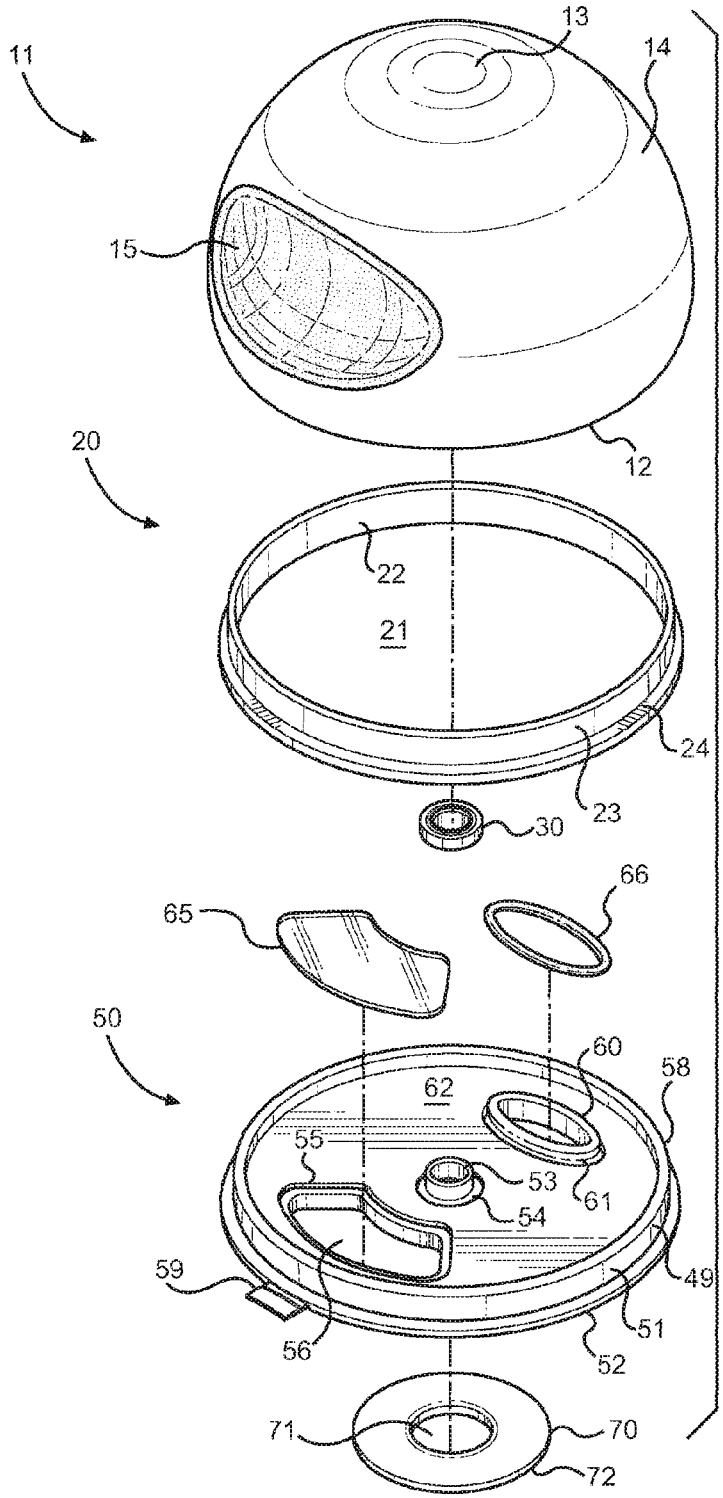

| | | | | |
|---|---|---|---|---|
| 2011/0008096 | A1* | 1/2011 | Coleman | B05B 11/0056 401/205 |
| 2012/0233795 | A1 | 9/2012 | Avshalom | |

* cited by examiner

SOAP DISPENSING BODY SCRUBBER

CROSS REFERENCE TO RELATED APPLICATION

This application claims the benefit of U.S. Provisional Application No. 62/142,159 filed on Apr. 2, 2015. The above identified patent application is herein incorporated by reference in its entirety to provide continuity of disclosure.

BACKGROUND OF THE INVENTION

Field of the Invention

The present invention relates to body scrubbers and cleaning devices. More specifically, the present invention relates to a soap dispensing body scrubber assembly that includes a top cap with a reservoir of liquid soap and a scrubber element that connects thereto. The user dispenses the liquid soap from the top cap to create a soap lather while cleaning.

Body scrubbers are popular cleaning devices because they develop a thick lather and can be used to exfoliate the user's skin. Scrubbers generally include a textured or abrasive surface that can be used in conjunction with soap to clean skin, remove dirt, and remove dead skin cells while bathing or showering. Common scrubbers include natural or synthetic sponges and loofahs. These devices are generally used with a liquid soap product, which is manually dispensed onto the scrubber to create the lather. The present invention provides a combined cleaning device that employs a refillable reservoir of liquid soap and an attachment for securing a replaceable scrubber element to the base thereof.

More specifically, the present invention provides a combination liquid soap dispenser and body scrubber device. The device includes a top cap with a fillable reservoir of liquid soap. The liquid soap is dispensed through a valve in the base of the top cap, which is induced to flow using one of a depressible button or squeezable top cap. The liquid soap flows through the valve and onto an attached body scrubber element. When combined with water in a shower or bath, the soap and scrubber develop a thick lather and the device can be used for cleaning while the user grips the top cap and applies the scrubber to the user's body. The scrubber element is replaceable and the top cap is refillable so the device may have an extended service life. In addition, the use of the top cap reservoir eliminates the need for a separate container of liquid soap within the shower while the device is in service.

SUMMARY OF THE INVENTION

The following summary is intended solely for the benefit of the reader and is not intended to be limiting in any way. The present invention provides a new soap-dispensing body scrubber that can be utilized for providing convenience for the user while cleaning or bathing.

It is therefore an object of the present invention to provide a new and improved soap-dispensing body scrubber that has all of the advantages of the prior art and none of the disadvantages.

It is another object of the present invention to provide a soap-dispensing body scrubber that comprises a top cap and an attachable scrubber element. The top cap supports a reservoir of liquid soap, which is dispensable onto the attached scrubber element.

Another object of the present invention is to provide soap-dispensing body scrubber in which the top cap has one or more sidewalls and a substantially planar lower surface. Within the top cap is an open interior volume adapted to support liquid soap therein. The planar lower surface of the top cap may include a surface extending thereacross to enclose the top cap, or the planar lower surface may be open and support a base attached thereto.

Another object of the present invention is to provide soap-dispensing body scrubber that comprises a one-way valve. The valve is disposed along the planar lower surface of the top cap or along the base thereof. The valve allows liquid soap to dispense therethrough and from the interior volume of the top cap.

Another object of the present invention is to provide soap-dispensing body scrubber in which the top cap further comprises a depressible button along one of its sidewalls, the depressible button pressurizing the open interior of the top cap to force liquid soap stored within its interior volume through the one-way valve.

Another object of the present invention is to provide soap-dispensing body scrubber in which the top cap further comprises a squeezable material such that squeezing the top cap forces liquid soap stored within the interior volume of the top cap through the one-way valve of the base.

Another object of the present invention is to provide soap-dispensing body scrubber that comprises a scrubber element having a scrubber connector adapted to removably secure the scrubber element to top cap. The scrubber connector has an aperture therethrough that is adapted to align with the one-way valve when connected to the top cap to facilitate communication of the liquid soap from the one-way valve and onto the scrubber element.

Another object of the present invention is to provide soap-dispensing body scrubber wherein the one or more sidewalls of the top cap curve substantially upward and inward from the planar lower surface to form an upper extent. In one embodiment, a depressible button is disposed along the upper extent thereof.

Another object of the present invention is to provide soap-dispensing body scrubber wherein the depressible button is positioned over a fill hole along the upper extent of the top cap. The fill hole provides access through the sidewalls of the top cap and into the open interior volume thereof. The depressible button is removable from the fill hole to reveal the fill hole when filling the top cap with liquid soap.

Another object of the present invention is to provide soap-dispensing body scrubber wherein the scrubber connector further comprises a planar surface with one or more apertures therein. The planar lower surface of the top cap comprises one or more tabs that align with the apertures of the planar surface of the scrubber connector to couple the scrubber connector to the planar lower surface of the top cap.

Another object of the present invention is to provide soap-dispensing body scrubber that further comprises an elongated handle extending from the top cap.

Another object of the present invention is to provide soap-dispensing body scrubber that further comprises a base having a removable lid, the lid being substantially coextensive with the base. The base extends across an open lower surface of the top cap and the lid is hingedly attached to the base such that the lid can be operably positioned over the base. The base supports the one-way valve and further comprises a fill hole therethrough. The lid of the base has a clearance aperture therethrough that aligns with the one-way valve of the base when the lid is positioned over the base.

Another object of the present invention is to provide soap-dispensing body scrubber wherein the scrubber connector of the scrubber element further comprises a disc with an aperture therethrough. The base has a male snap coupler member comprising one or more upstanding flanges, the flanges each having an outwardly extending ledge. The one or more flanges are adapted to be received through the aperture of the disc when the disc is pressed over the one or more flanges such that the disc is secured between the ledge of each flange and the base.

Another object of the present invention is to provide soap-dispensing body scrubber wherein the lid is hingedly attached to the base via a living hinge.

Another object of the present invention is to provide soap-dispensing body scrubber wherein the lid further comprises an upstanding fill hole plug that is adapted to align with the fill hole of the base when the lid is positioned over the base, thereby sealing the fill hole.

Another object of the present invention is to provide soap-dispensing body scrubber wherein the upstanding fill hole plug further comprises an O-ring therearound to seal the fill hole when the fill hole plug is disposed within the fill hole of the base.

Another object of the present invention is to provide soap-dispensing body scrubber wherein the lid further comprises a viewing window therethrough. The viewing window of the lid aligns with a viewing window aperture along the base when the lid is positioned over the base such that the open interior of the top cap is visible through the viewing window.

Another object of the present invention is to provide soap-dispensing body scrubber wherein the top cap further comprises a lower edge and an inner liner attached thereto, whereby the top cap is molded to the inner liner. The inner liner comprises a peripheral channel extending therearound and the top cap comprises a molded material, whereby the molded material flows into the peripheral channel when the top cap is molded to the liner. The base is adhered to the interior surface of inner liner after being molded to the top cap.

Another object of the present invention is to provide soap-dispensing body scrubber wherein the inner liner further comprising internal threads base and the base comprising external threads. The base is threadably attached to the liner after being molded to top cap.

Another object of the present invention is to provide soap-dispensing body scrubber wherein the top cap further comprises a pair of grip indentations. The grip indentations are opposed to one another along opposite sides of the top cap.

Another object of the present invention is to provide soap-dispensing body scrubber wherein the top cap comprises a molded santoprene material and the base comprise a polypropylene material.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

FIG. 1 provides an exploded view of an embodiment of the soap dispensing scrubber device of the present invention.

Figure 2:
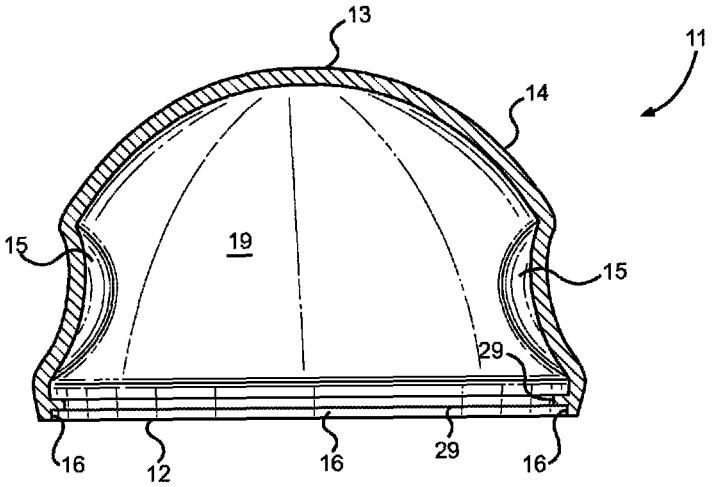

FIG. 2 provides a cross section view of the top cap.

Figure 2A:
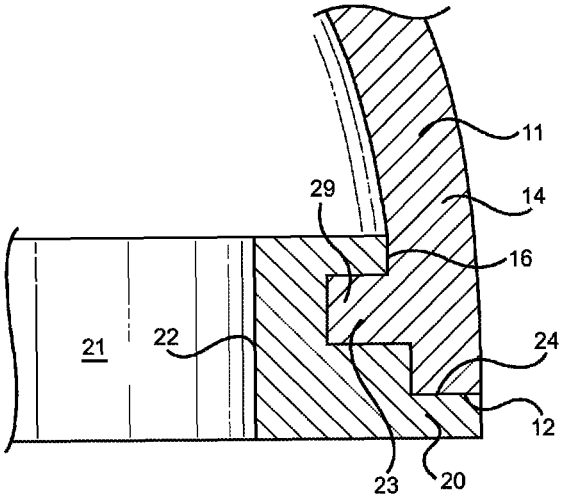

FIG. 2A provides a cross section view of the joint between the liner and the top cap.

Figure 3:
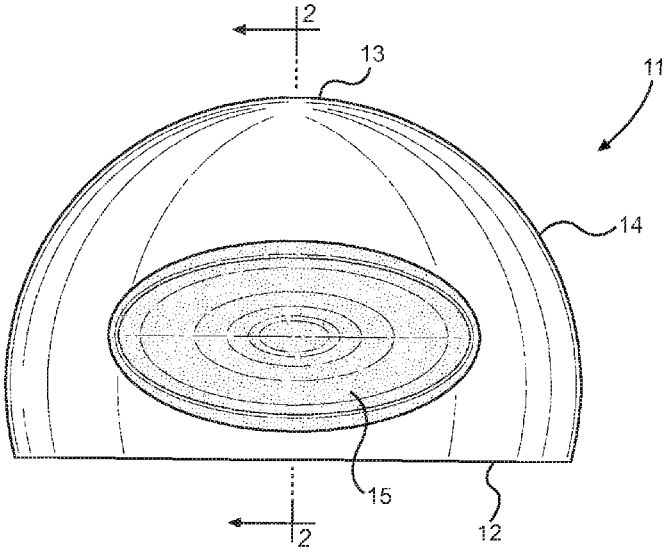

FIG. 3 provides a side view of the top cap.

Figure 4:
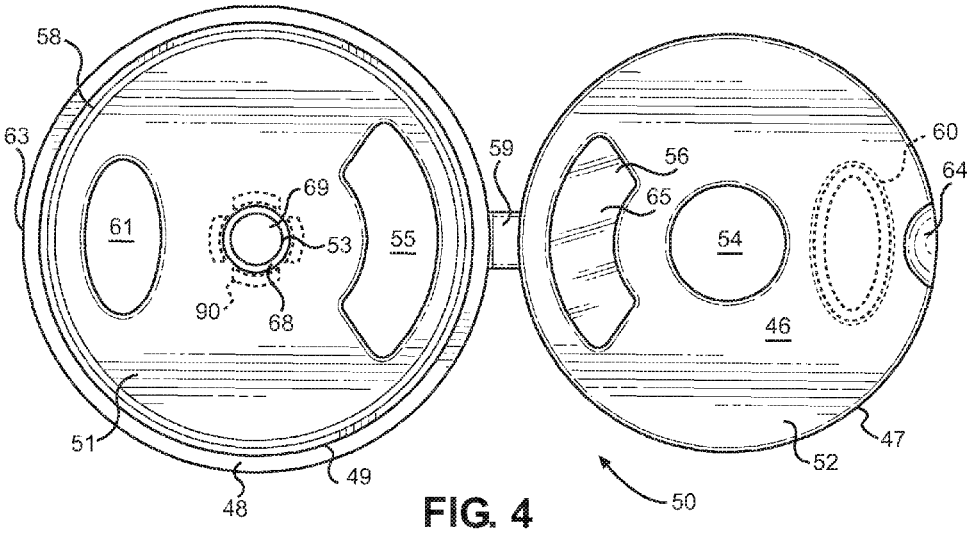

FIG. 4 provides an overhead view of the base-lid assembly.

Figure 5:
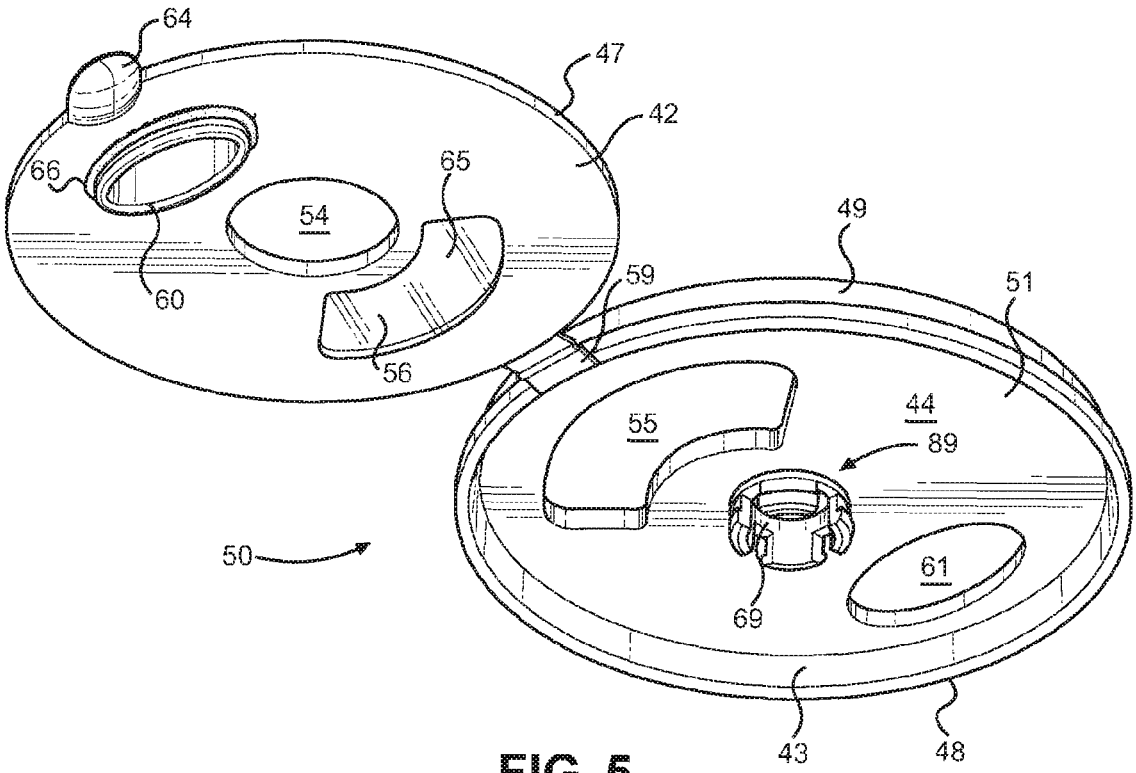

FIG. 5 provides an underside perspective view of the base-lid assembly.

Figure 6:
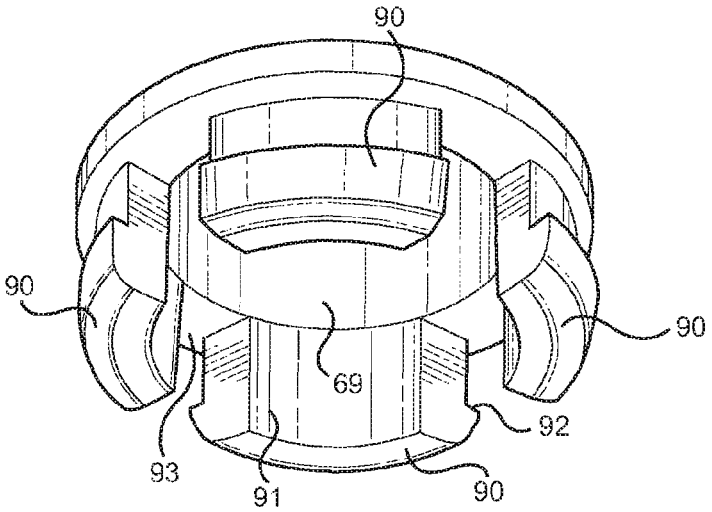

FIG. 6 provides a view of the male snap coupler member along the base of the device.

Figure 7:
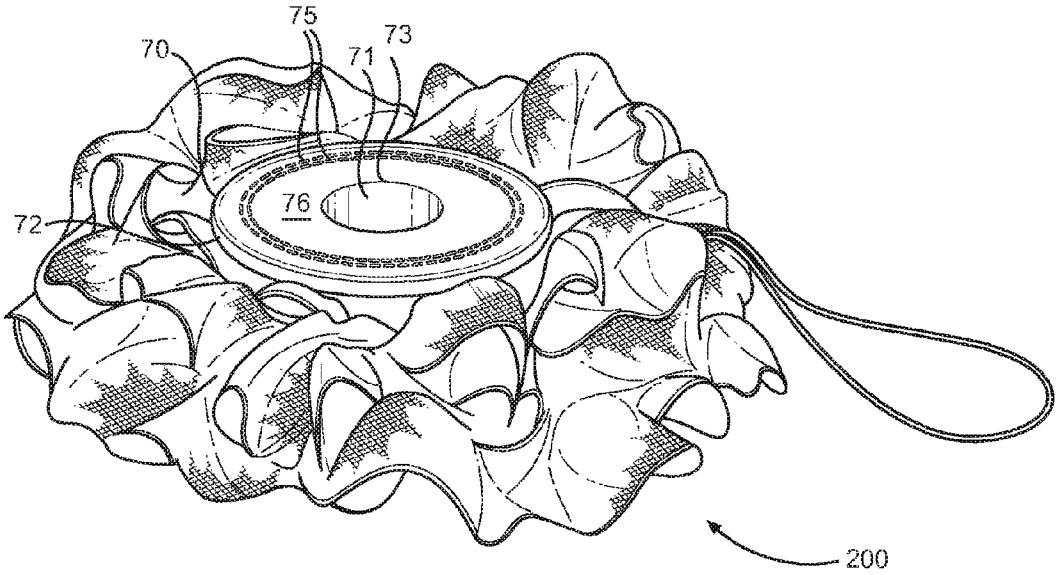

FIG. 7 provides a view of the disc and an exemplary embodiment of the scrubber element.

Figure 8:
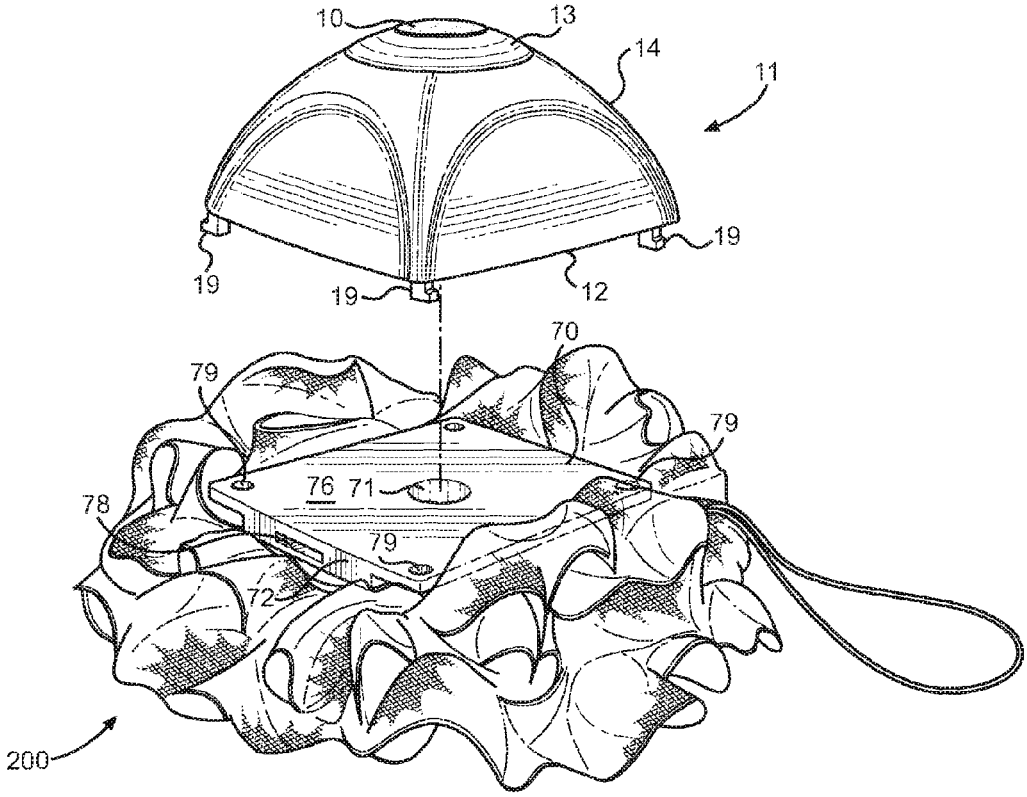

FIG. 8 provides an exploded view of an embodiment of the soap dispensing scrubber device of the present invention.

Figure 9:
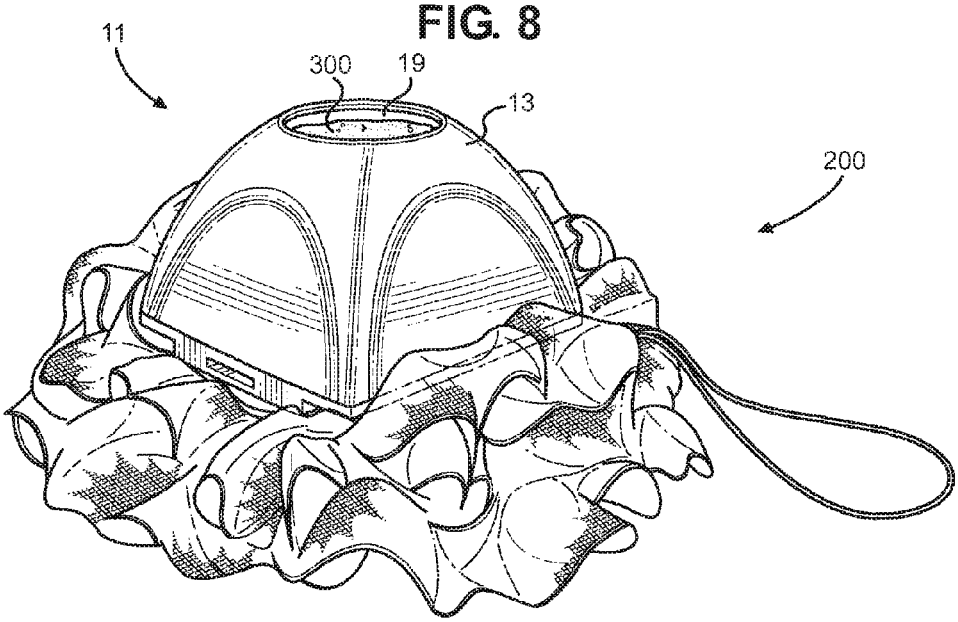

FIG. 9 provides another view of an embodiment of the soap dispensing scrubber device of the present invention.

Figure 10:
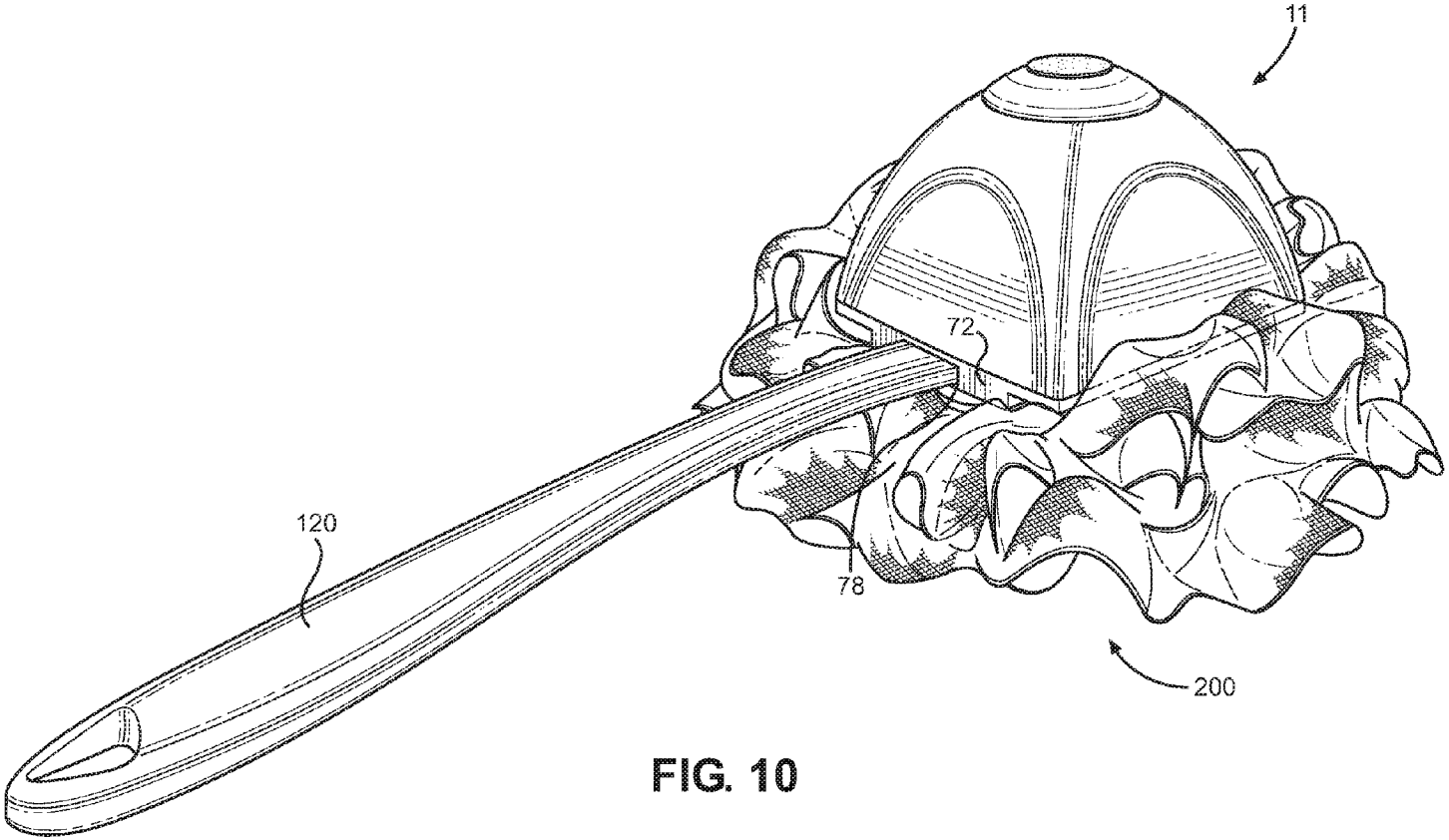

FIG. 10 provides a view of an embodiment of the soap dispensing scrubber device and an elongated handle affixed thereto.

DETAILED DESCRIPTION OF THE INVENTION

Reference is made herein to the attached drawings. Like reference numerals are used throughout the drawings to depict like or similar elements of the soap dispensing scrubber device of the present invention. For the purposes of presenting a brief and clear description of the present invention, the preferred embodiment will be discussed as used for storing liquid soap within a top cap, dispensing the soap directly onto an attached scrubber element, and using the scrubber element and lather therefrom to shower or bath. The figures are intended for representative purposes only and should not be considered to be limiting in any respect.

Referring to FIGS. 1-5, there are shown views of an embodiment of the soap dispensing scrubber device. The soap dispensing scrubber device of the present invention is one that supports a reservoir of liquid soap that can be dispensed onto a scrubber, such as a sponge, loofah, or the like, and handled to wash and scrub the user. The device comprises a top cap 11 having a substantial dome shape that is easily grasped and held by the user. The top cap 11 has one or more sidewalls 14 that extend from a planar lower surface 12. The sidewalls 14 preferably curve substantially upward and inward from the lower surface 12, forming a rounded profile with an upper extent 13. In some embodiments, a physical button is provided along the top cap 11 in order to induce liquid soap to dispense therefrom. In a preferred configuration, the top cap 11 comprises a squeezable material such that squeezing inward on the sidewalls 14 of the top cap 11 forces liquid soap stored within the interior volume thereof through the lower surface 12 and through a one-way valve 30. In this squeezable embodiment, grip indentations 15 may be provided along the sidewalls 14 for improved purchase of the top cap 11 while handling the same.

The top cap 11 stores liquid soap within its interior volume 19 and connects to a one-way valve 30 along its lower surface 12. Supporting the one-way valve 30 is a base-lid assembly 50 that extends across the open lower surface 12 of the top cap 11. In this embodiment, the top cap lower surface 12 is open and receives the base-lid assembly 50 therein. The base-lid assembly 50, in turn, comprises a base 51 and a hingedly attached lid 52 that forms over the base 51 and is hingedly attached to the base 51 via a hinge 59. The lid 52 and the base 51 are substantially coextensive with one another, and the base-lid assembly 50 is substantially coextensive with the open lower surface 12 of the top cap 11.

In the squeezable embodiment of the top cap 11, the top cap 11 is comprised of a molded polymer material that holds its shape and is easily squeezed with one hand. After being squeezed, the material returns to its original shape. One exemplary material contemplated for the top cap 11 is a santoprene thermoplastic vulcanizate (TPV) material. The santoprene material is molded into the shape of the top cap 11, whereafter the base-lid assembly 50 is adhered thereto. The base-lid assembly 50 is preferably a polypropylene material. The physical properties of santoprene material make it highly suited for a squeezable structure such as the top cap 11, while a polypropylene base-lid assembly 50 provides the necessary structure, stiffness, and durability to enclose the liquid soap within the top cap 11. The base-lid assembly 50 remains rigid as the top cap 11 is squeezed, maintaining a flat lower surface that supports a scrubber thereunder. The polypropylene material also ensures the base 51 and lid 52 remain intact while squeezed, while also ensuring the hinge 59 does not fail over repeated cycles of coupling and decoupling the lid 52 from the base 51.

In order to achieve a desired connection between a santoprene top cap 11 and a polypropylene base-lid assembly 50, an internal liner 20 is provided. The liner 20 is an intermediary between the top cap 11 and the base-lid assembly 50, whereby the top cap 11 is molded to the liner 20 during the top cap molding process, and the base-lid assembly 50 is adhered to the liner 20 using a suitable adhesive after the molding process. More specifically, the top cap 11 is molded so that it has an internal surface 16 along its lower surface 12. The liner 20 comprises a peripheral channel 23 along its outer surface and a lower lip 24. The santoprene material of the top cap 11, when molded, flows from the internal surface 16 and into the channel 23 of the liner 20 such that the internal surface 16 of the top cap 11 fills the channel 23 and locks the liner 20 to the internal surface 16 of the top cap 11 (see FIG. 2A). The liner 20, in turn, comprises a ring-shaped member with an open interior 21, an outer perimeter, and an interior surface 22. After the liner 20 and top cap 11 are molded together, the base-lid assembly 50 is attached and adhered to the interior surface 22 of the liner 20.

The shape of the liner channel 23, its extent along the perimeter of the liner 20, the direction of the channel 23 along the internal surface 16 of the top cap 11, and the number of channels 23 provided along the liner 20 may vary. FIGS. 1, 2, and 2A provide views of an exemplary embodiment of the liner. Referring specifically to FIG. 2A, the joint between the liner 20 and the top cap 11 is visualized. The channel 23 of the liner extends around the perimeter of the liner 20 and aligns with the internal surface 16 of the top cap 11 during the molding process. A mold allows liquid santoprene material to flow therethrough and into the channel 23 of the liner, forming the sidewalls 14 of the top cap 11, the internal surface 16, and an inward protrusion 29 of material in the channel 23. The material of the top cap 11 forms the inward protrusion 29 during the molding process when its material fills the channel 23. The formed lower edge 12 of the top cap 11 also abuts against the outer surface and lip 24 of the liner 20.

After the molding process, the internal surface 22 of the liner 20 is exposed within the interior of the top cap 11. The exposed internal surface 22 then receives the base-lid assembly 50 thereagainst. The base-lid assembly 50 is positioned within the open interior 21 of the liner 20, pressed thereagainst and adhered thereto. An appropriate adhesive joints the liner 20 to the base-lid assembly 50, which are both preferably a polypropylene material. This permanently secures the base-lid assembly 50 to the lower surface 12 of the top cap 11 with the liner 20 therebetween. In an alternate embodiment, the interior surface 22 of the liner 20 may include an internal thread pitch. The internal threads threadably engage complementary external threads along the peripheral lip 48 of the base 51. The addition of threads is contemplated but is not preferred.

The base-lid assembly 50 of the device provides a base 51 that secures over the open lower surface 12 of the top cap 11, meters liquid soap onto an attached scrubber element, and provides a lid 52 that secures over the base 51 while the scrubber device is in use. Referring to FIGS. 1, 4 and 5, the base-lid assembly 50 comprises two components: the base 51 and the lid 52. The base 51 and lid 52 are substantially coextensive and overlap one another when the scrubber device is being used. The base 52 comprises a base surface 44 that extends across the open lower of the top cap 11 and supports the one-way valve 30 therealong. The base 52 furthermore comprises a fill hole 61 that is used to refill the top cap 11 interior with liquid soap.

The lid 52 of the base-lid assembly 50 comprises a lid surface 46 that is substantially coextensive with the base surface 44. The lid surface 46 comprises a fill hole plug 60 that is adapted to be received within the fill hole 61 of the base 51 when the base 51 and lid 52 are joined. The fill hole plug 60 comprises an upstanding member that is inserted into the open fill hole 61. Along the base of the fill hole plug 60 is an O-ring 66 or similar sealing member. This ensures the fill hole 61 is sealed when the plug 60 is inserted through the fill hole 61 to prevent liquid soap from leaking therethrough. When the top cap 11 needs to be refilled with liquid soap, the lid 52 is removed from the base 51 and the fill hole 61 is revealed. The user, holding the top cap 11 in an inverted state, can then fill the top cap 11 with soap through the exposed fill hole 61. The lid 52 can then be reattached to the base 51, sealing the liquid soap within the top cap.

In some embodiments, the base 51 may further comprise a viewing aperture 55. The viewing aperture aligns with a viewing window 65 disposed within a complimentary viewing aperture 56 in the lid 52. The viewing apertures 55, 56 of the base 51 and lid 52 align when attached and the viewing window 65 allows the user to see through the base-lid assembly 50. The viewing window is a transparent material, such as acrylic or the like. This allows the user to inspect the interior of the top cap 11 and see how much soap remains therein without removing the lid 52 from the base 51.

The base 51 preferably comprises a base surface 44 and an upstanding peripheral lip 48 extending around the edge of the base surface 44. The lip 48 includes an exterior surface 49 and an interior surface 43. The exterior surface 49 of the lip 48 is affixed to the liner 20, while the interior surface 43 of the lip 48 surrounds the outer periphery 47 of the lid 52 when the lid 52 is nested against the base surface 44 and inside the peripheral lip 48 of the base 51. When pressed together, the fill hole plug 60 of the lid 52 engages the fill hole 61 of the base, and the viewing apertures 55, 56 align with one another.

In addition, when the lid 52 and base 51 are joined, the lid 52 comprises a clearance aperture 54 that provides clearance for a scrubber coupler member 89 along the base 52. The scrubber coupler member 89 is adapted to removably affix the scrubber connector 70 of a scrubber element to the base 52, whereby liquid soap is dispensed through the scrubber connector 70 and directly into the scrubber element. The clearance aperture 54 of the lid 52 allows the lid 52 to secure over the base 51 without interfering with the coupler member 89. Therefore, the scrubber element must be removed from the base 51 before the lid 52 is detached from the base 52. To assist removal of the lid 52 once nested within the lip 48 of the base, an upstanding pull tab 64 may be provided along the outer edge 47 of the lid 52. The user lifts the pull tab 64 to remove the lid 52 from the base 51.

Preferably, the scrubber coupler member 89 aligns with a dispensing aperture 69 in the base 51, which further aligns with the one-way valve 30. The one-way valve 30 is preferably a silicone one-way valve that dispenses liquid soap when the soap is pressed therethrough from the top cap 11. When the user squeezes the top cap 11 or presses a dispensing button therealong, the liquid soap is forced through the one-way valve 30. The valve 30 is biased in one direction and opens in one direction based on fluid pressure of the soap. The valve 30 then closes once the fluid pressure of the soap ceases to open the valve 30. The one-way valve 30 is aligned with a dispensing aperture 69 in the base 51, which furthermore aligns with the scrubber coupler member 89 and the clearance aperture 54 of the lid 52. In a preferred embodiment, these aligned elements are centrally located along the base-lid assembly 50.

The one-way valve 30 is nested within the interior of a valve support 53 along the upper surface 44 of the base 51. The valve support 53 comprises an upstanding shoulder that supports the periphery of the rounded valve 30. The valve 30 is placed within the interior of the valve support 53 and abuts against the upstanding shoulders thereof. The valve 30 is preferably glued against the shoulders of the valve support. Below the valve support 53 is the dispensing aperture 69 of the base 51. When the valve 30 dispenses liquid soap, it communicates through the dispensing aperture 69 and through the scrubber coupler member 89. In this way, the soap is dispensed in metered amounts by the user, and directly into the interior of the scrubber element attached to the scrubber coupler member 89.

The scrubber coupler member 89 is one that is adapted to support the scrubber coupler 70 of the scrubber element. Referring now to FIGS. 1, 6 and 7, there are shown views of preferred embodiments of the scrubber coupler member 89 and the scrubber coupler 70. As shown, the preferred embodiment of the scrubber coupler 70 comprises a rounded disc with a central aperture 71. The disc preferably comprises a rounded outer edge 72 and a flat upper surface 76 that is adapted to abut against the base-lid assembly 50. The disc preferably comprises an ABS plastic material and is supported along a scrubber element 200. The disc is furthermore preferably sewn to the scrubber element 200, which may comprise a loofah. Sewn lines of connection 75 secure the disc to the scrubber element 200, while the scrubber coupler member 89 secures the disc to the base-lid assembly 50.

The preferred embodiment of the scrubber coupler member 89 comprises male snap coupler assembly comprising one or more upstanding flanges 90. As shown in detail in FIG. 6, the male snap coupler assembly comprises one or more upstanding flanges 90. One continuous flange may be employed, however multiple flanges 90 separated by small gaps 93 is preferred. This allows each flange 90 to flex when securing the disc of the scrubber coupler 70. In addition, the one or more flanges 90 have an outwardly protruding ledge 92 that is substantially parallel to the base surface. The ledges 92 secure over the outer surface 76 of the disc and retain the disc between the ledges 92 and the base-lid assembly 50. More specifically, one or more flanges 90 of the male snap coupler assembly are adapted to be received through central aperture 71 of the disc when the disc is pressed over the one or more flanges 90 such that the disc is secured between the ledge 92 of each flange 90 and the base 51. The flanges 90 flex inward as the ledges 92 form over the inner edge 73 of the disc central aperture 71. The flanges 90 then spring back into their upright condition with the ledges 92 deployed over the disc outer surface 76 when the disc is fully engaged with the le snap coupler assembly. Finally, when the disc of the scrubber coupler 70 is secured to the male snap coupler assembly, the central aperture 71 thereof aligns with the dispensing aperture 69 in the base 51.

Referring now to FIGS. 8-10, there are shown views of an alternate embodiment of the soap-dispensing body scrubber of the present invention. In this embodiment, the top cap 11 is comprised of a rigid material that is not readily squeezable. The one or more sidewalls 14 of the top cap 11 curve substantially upward and inward from the planar lower surface 12 to form an upper extent 13. Along the upper extent 13 is a depressible button 10 that is used to induce the flow of liquid soap within the top cap through a one-way valve along the lower surface 12 of the top cap 11.

In this alternate embodiment, the depressible button 10 of the top cap 11 is positioned over an uppermost fill hole 19 along the upper extent 13 of the top cap 11. The uppermost fill hole 19 provides access through the sidewalls 14 of the top cap 11 and into the open interior volume thereof to fill the interior with liquid soap 300. Therefore, the depressible button 10 is removable from the fill hole 19 to reveal the fill hole 19 when filling the top cap 11 with liquid soap 300. After filling, the button 10 is placed over the uppermost fill hole 19 and is used to induce the flow of soap 300 from the top cap 11 and onto the attached scrubber element 200. The button is preferably a flexible rubber or suitable polymer material.

The alternate embodiment of the soap-dispensing body scrubber of the present invention contemplates one or more connector tabs 19 along the lower surface 12 of the top cap 11 to secure the top cap 11 to the scrubber connector 70 of the scrubber element 200. In this embodiment, the tabs 19 are flexible members with an internal ledge that align with apertures 79 along the scrubber connector 70 to couple the scrubber connector 70 to the planar lower surface 12 of the top cap 11. The scrubber connector 70 preferably comprises a planar upper surface 76 that is adapted to abut against the lower surface 12 of the top cap 11. When connected, a central aperture 71 in the scrubber connector 70 aligns with the one-way valve and dispensing aperture in the lower surface 12 of the top cap 11.

In addition to gripping the top cap 11 while using the scrubber element 200, it is contemplated that a handle 120 may be provided that affixes to an edge 72 of the scrubber connector 70. In particular, the elongated handle may comprise a handle tab proximal end that engages a handle insert aperture 78 along the side 72 of the scrubber connector 70. The addition of the handle 120 allows the user to locate the scrubber 200 in hard-to-reach areas of the body after soap has been dispensed onto the scrubber element 200. It is also contemplated that he handle tab proximal may engage a handle insert aperture 78 in extending through the base-lid assembly 50 in the preferred embodiment.

Overall, the present invention provides a device that stores liquid soap and dispenses liquid soap from a top cap and onto a desired scrubber. No claim is made herein to a specific style scrubber, nor is it desired to limit the top cap and base-lid assembly to a particular material. Rather, exemplary embodiments are provided that have been shown to operate well for the desired function. Additionally, the specific style scrubber coupler and connector therefore may take on different forms and designs, falling within the scope of the claims. The device provides a useful cleaning tool, and one that can be refilled periodically and be updated with different or newer scrubber elements.

It is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A soap-dispensing body scrubber, comprising:

a top cap having one or more sidewalls and an open lower surface;

the top cap having an open interior volume adapted to support liquid soap therein;

a base having a removable lid, the lid being substantially coextensive with the base;

wherein the base extends across the open lower surface of the top cap and the lid is hingedly attached to the base such that the lid can be operably positioned over the base;

the base further comprising a one-way valve and a fill hole therethrough;

the lid having a clearance aperture therethrough that aligns with the one-way valve of the base when the lid is positioned over the base;

the top cap further comprising a squeezable material such that squeezing the top cap forces liquid soap stored within the interior volume of the top cap through the one-way valve of the base;

a scrubber element having a scrubber connector adapted to secure to the base;

the scrubber connector having an aperture therethrough adapted to align with the one-way valve of the base when connected to the base to facilitate communication of the liquid soap from the one-way valve and onto the scrubber element.

2. The soap-dispensing body scrubber of claim 1, wherein:

the scrubber connector of the scrubber element further comprises a disc;

the base having a male snap coupler member comprising one or more upstanding flanges, the flanges each having an outwardly extending ledge;

the one or more flanges adapted to be received through the disc of the scrubber connector when the disc is pressed over the one or more flanges such that the disc is secured between the ledge of each flange and the base.

3. The soap-dispensing body scrubber of claim 1, wherein the lid is hingedly attached to the base via a living hinge.

4. The soap-dispensing body scrubber of claim 1, wherein:

the lid further comprises an upstanding fill hole plug that is adapted to align with the fill hole of the base when the lid is positioned over the base, thereby sealing the fill hole.

5. The soap-dispensing body scrubber of claim 4, wherein:

the upstanding fill hole plug further comprises an O-ring therearound to seal the fill hole when the fill hole plug is disposed within the fill hole of the base.

6. The soap-dispensing body scrubber of claim 1, wherein:

the lid further comprises a viewing window therethrough;

the viewing window of the lid aligning with a viewing window aperture along the base when the lid is positioned over the base such that the open interior of the top cap is visible through the viewing window.

7. The soap-dispensing body scrubber of claim 1, wherein:

the top cap further comprises a lower edge and an inner liner attached thereto, whereby the top cap is molded to the inner liner;

the inner liner comprises a peripheral channel and the top cap comprises a molded material, whereby the molded material flows into the peripheral channel when the top cap is molded to the liner; and wherein the base is adhered to the inner liner.

8. The soap-dispensing body scrubber of claim 1, wherein:

the top cap further comprises a lower edge and an inner liner attached thereto, whereby the top cap is molded to the inner liner;

the inner liner comprises a peripheral channel and the top cap comprises a molded material, whereby the molded material flows into the peripheral channel when the top cap is molded to the liner;

the inner liner further comprising internal threads base and the base comprising external threads;

the base being threadably attached to the liner.

9. The soap-dispensing body scrubber of claim 1, wherein:

the top cap further comprises a pair of grip indentations;

the grip indentations being opposed to one another along opposite sides of the top cap.

10. The soap-dispensing body scrubber of claim 1, wherein:

the top cap comprises a molded santoprene material and the base comprises a polypropylene material.

11. The soap-dispensing body scrubber of claim 10, wherein:

the top cap further comprises a lower edge and an inner liner attached thereto, whereby the top cap is molded to the inner liner;

the inner liner comprises a peripheral channel and the top cap comprises a molded material, whereby the molded material flows into the peripheral channel when the top cap is molded to the liner; and wherein the base is adhered to the inner liner.

12. The soap-dispensing body scrubber of claim 10, wherein:

the top cap further comprises a lower edge and an inner liner affixed thereto;

the inner liner having a plurality of channels therethrough, whereby the top cap comprises a molded material that flows into the channels to secure the inner liner to the top cap;

the inner liner further comprising internal threads base and the base comprising external threads;

the base being threadably attached to the liner.

13. The soap-dispensing body scrubber of claim 10, wherein:

the top cap further comprises a pair of grip indentations;

the grip indentations being opposed to one another along opposite sides of the top cap.

14. The soap-dispensing body scrubber of claim 10, wherein:

the top cap comprises a molded santoprene material and the base comprises a polypropylene material.

15. A soap-dispensing body scrubber, comprising:

a top cap having one or more sidewalls and an open lower surface;

the top cap having an open interior volume adapted to support liquid soap therein;

a base having a removable lid, the lid being substantially coextensive with the base;

wherein the base extends across the open lower surface of the top cap and the lid is hingedly attached to the base such that the lid can be operably positioned over the base;

the base further comprising a one-way valve and a fill hole therethrough;

the lid having a clearance aperture therethrough that aligns with the one-way valve of the base when the lid is positioned over the base;

the top cap further comprising a squeezable material such that squeezing the top cap forces liquid soap stored within the interior volume of the top cap through the one-way valve of the base;

the base having a male snap coupler member extending therefrom that comprises one or more upstanding flanges, the flanges each having an outwardly extending ledge;

wherein the one or more flanges are adapted to be received through a scrubber connector disc such that the scrubber connector disc is secured between the ledge of each flange and the base when the scrubber connector disc is pressed over the one or more flanges.

16. The soap-dispensing body scrubber of claim 15, wherein the lid is hingedly attached to the base via a living hinge.

17. The soap-dispensing body scrubber of claim 15, wherein:

the lid further comprises an upstanding fill hole plug that is adapted to align with the fill hole of the base when the lid is positioned over the base, thereby sealing the fill hole.

18. The soap-dispensing body scrubber of claim 17, wherein:

the upstanding fill hole plug further comprises an O-ring therearound to seal the fill hole when the fill hole plug is disposed within the fill hole of the base.

19. The soap-dispensing body scrubber of claim 15, wherein:

the lid further comprises a viewing window therethrough;

the viewing window of the lid aligning with a viewing window aperture along the base when the lid is positioned over the base such that the open interior of the top cap is visible through the viewing window.

* * * * *